US009670018B2

(12) United States Patent
Ogasawara et al.

(10) Patent No.: US 9,670,018 B2
(45) Date of Patent: Jun. 6, 2017

(54) SHEET TRANSPORTING DEVICE, DOCUMENT FEEDER, AND IMAGE FORMING APPARATUS

(71) Applicant: Sharp Kabushiki Kaisha, Osaka-shi, Osaka (JP)

(72) Inventors: Hironori Ogasawara, Osaka (JP); Toshiki Ohgita, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 14/834,488

(22) Filed: Aug. 25, 2015

(65) Prior Publication Data

US 2016/0060054 A1 Mar. 3, 2016

(30) Foreign Application Priority Data

Sep. 1, 2014 (JP) ..... 2014-177425

(51) Int. Cl.

| | |
|---|---|
| ***B65H 5/26*** | (2006.01) |
| ***B65H 5/36*** | (2006.01) |
| ***B65H 29/58*** | (2006.01) |
| ***B65H 5/06*** | (2006.01) |

(52) U.S. Cl.

CPC ..... *B65H 5/26* (2013.01); *B65H 5/062* (2013.01); *B65H 5/36* (2013.01); *B65H 29/58* (2013.01); *B65H 2401/115* (2013.01); *B65H 2404/511* (2013.01); *B65H 2404/512* (2013.01); *B65H 2404/6111* (2013.01); *B65H 2601/521* (2013.01); *B65H 2801/06* (2013.01); *B65H 2801/39* (2013.01)

(58) Field of Classification Search

CPC . B65H 5/36; B65H 5/38; B65H 85/00; B65H 3/66; B65H 3/68; B65H 29/58

See application file for complete search history.

(56) References Cited

U.S. PATENT DOCUMENTS 6,698,752 B1 * 3/2004 Kakuta ..... B65H 5/38 271/188
7,212,321 B2 * 5/2007 Sugiyama ..... B65H 9/006 271/186

FOREIGN PATENT DOCUMENTS

| | | | |
|---|---|---|---|
| JP | 2000034030 A | * | 2/2000 |
| JP | 2000355441 A | * | 12/2000 |
| JP | 2003081482 A | * | 3/2003 |
| JP | 2003212376 A | * | 7/2003 |
| JP | 2004-354422 A | | 12/2004 |
| JP | 3762849 B2 | | 4/2006 |
| JP | 2007106551 A | * | 4/2007 |
| JP | 2013043724 A | * | 3/2013 |

* cited by examiner

*Primary Examiner* — Luis A Gonzalez
(74) *Attorney, Agent, or Firm* — Keating & Bennett, LLP

(57) ABSTRACT

A sheet transporting device in which a curved transport path is provided downstream in a sheet transport direction from a merging section where a plurality of transport paths, which are formed by transport guides for transporting sheets, merge, is provided. The sheet transporting device includes a sheet guide member that extends towards the curved transport path from the merging section, with an extending end portion of the sheet guide member being disposed so as not to contact the transport guides. The sheet guide member reduces jumping up of a trailing end portion of a sheet caused by flexing of the sheet passing through the merging section towards the curved transport path.

20 Claims, 15 Drawing Sheets

SHEET TRANSPORTING DEVICE, DOCUMENT FEEDER, AND IMAGE FORMING APPARATUS

BACKGROUND

1. Field

The present disclosure relates to a sheet transporting device having a structure in which a curved transport path is provided downstream in a sheet transport direction from a merging section where a plurality of transport paths, which are formed by transport guides for transporting sheets, merge; a document feeder including the sheet transporting device; and an image forming apparatus including the document feeder.

2. Description of the Related Art

Hitherto, a sheet transporting device and an image forming apparatus including a movable transport guide that is rotatably provided at a merging section where a plurality of transport paths merge have been disclosed (refer to, for example, Japanese Unexamined Patent Application Publication No. 2004-354422 (PTL 1)).

The sheet transporting device is provided with a first transport path for sheets that are sent out from a sheet-feed cassette, a second transport path for sheets that are sent out from a manual feeder, a third transport path for transporting sheets during duplex printing, and a pair of register rollers that rotate while they form a nip region. The transport paths form a transport path merging section by merging into one path at a location that is upstream in a transport direction of the pair of register rollers for causing an end portion of an image that is formed on a photoconductor drum and a leading end portion of a sheet to be synchronized with each other.

The first transport path is formed between a first stationary guide and a second stationary guide. The second transport path is formed between the second stationary guide, a third stationary guide, and the movable transport guide (provided on a line of extension of the third stationary guide). The third transport path is formed between the third stationary guide, the movable transport guide (provided on the line of extension of the third stationary guide) and a fourth stationary guide.

In this structure, the movable transport guide is movable for guiding sheets to the nip region between the pair of register rollers, and an end portion of the movable transport guide is formed so as to contact the first stationary guide at a location near the nip region.

According to this structure, even if a sheet is curled, it is possible to properly guide the sheet to the nip region while reducing the curl by the movable transport guide.

However, as shown in FIG. 15, in a sheet transporting device having a structure in which a curved transport path 143 is provided downstream in a sheet transport direction Y11 from a merging section P11 where a plurality of transport paths (for example, two transport paths, such as a transport path 141 and a transport path 142), which are formed by transport guides for transporting sheets, merge, the following occurs. That is, a sheet M that is transported to the curved transport path 143 from the merging section P11 via the lower transport path 142 that is disposed at a side of the curved transport path 143 (that is, at the same side in a curving direction in a height direction) is transported such that its leading end portion M1 is transported into the curved transport 143 before its trailing end portion M2 passes the merging section P11.

Therefore, the sheet M in this state of transportation is in a state in which its leading end portion M1 is curved into a U shape by the curved transport path 143. When, in this state, the trailing end portion M2 of the sheet M moves to the merging section P11 from the transport path 142, flexing force of the sheet M that passes the interior of the curved transport path 143 causes the trailing end portion M2 of the sheet M to jump up in a direction opposite to a flexing direction of the sheet (indicated by an alternate long and two short dashed line in FIG. 15).

At this time, at the merging section P11, a large height difference D11 exists between a transport guide 142*a* at the upper side of the transport path 142 and a transport guide 141*a* at the upper side of the merging section P11. Therefore, the trailing end portion M2 of the sheet M jumps up by a large amount and forcefully strikes the transport guide 141*a* at the merging section P11. This causes a striking sound (unpleasant sound) to be generated. In particular, when a sheet is stiff, the sheet jumps up more strongly. This causes a louder striking sound (unpleasant sound) to be generated.

This problem is caused by the fact that the sheet is curved along the curved transport path because, when the trailing end portion of the sheet moves to the merging section from one of the transport paths, the leading end portion of the sheet is being transported in the curved transport path that is at a closest location at the downstream side in the transport direction.

PTL 1 discloses the technology of providing a movable transport guide for reducing a curl of a sheet. However, the transport path structure in PTL 1 and the transport path structure in FIG. 15 above differ from each other (that is, in PTL 1, a curved transport path does not exist near the downstream side of the merging section). Therefore, the problem that exists in the transport structure shown in FIG. 15 does not exist in the transport structure in PTL 1. Consequently, even if the movable transport guide described in PTL 1 is applied as it is to the transport path structure shown in FIG. 15, the problem that exists in the transport structure shown in FIG. 15 still exists.

SUMMARY

To address such a problem, it is desirable to provide a sheet transporting device, a document feeder, and an image forming apparatus, which are capable of eliminating or reducing an unpleasant sound, such as a striking sound, by reliably reducing jumping up of a trailing end portion of a sheet caused by a flexing force of the sheet passing the interior of a curved transport path when the trailing end portion moves to a merging section from one of transport paths.

According to an aspect of the disclosure, there is provided a sheet transporting device in which a curved transport path is provided downstream in a sheet transport direction from a merging section where a plurality of transport paths, which are formed by transport guides for transporting sheets, merge. The sheet transporting device includes a sheet guide member that extends in the merging section towards the curved transport path from, of the transport guides, a transport guide that is positioned at a central portion of the merging section. In the sheet transporting device, the sheet guide member is disposed such that an extending end portion of the sheet guide member does not contact the other transport guide or the other transport guides in the merging section.

According to another aspect of the disclosure, there is provided a document feeder including the sheet transporting device having the above-described structure.

According to still another aspect of the disclosure, there is provided an image forming apparatus including the document feeder having the above-described structure.

DESCRIPTION OF THE EMBODIMENTS

Embodiments according to the disclosure are hereunder described with reference to the drawings.

First Embodiment

In a first embodiment, a sheet transporting device according to the disclosure is described as being applied to a document feeder installed in an image forming apparatus.

Description of Overall Structure of Image Forming Apparatus

Figure 1:
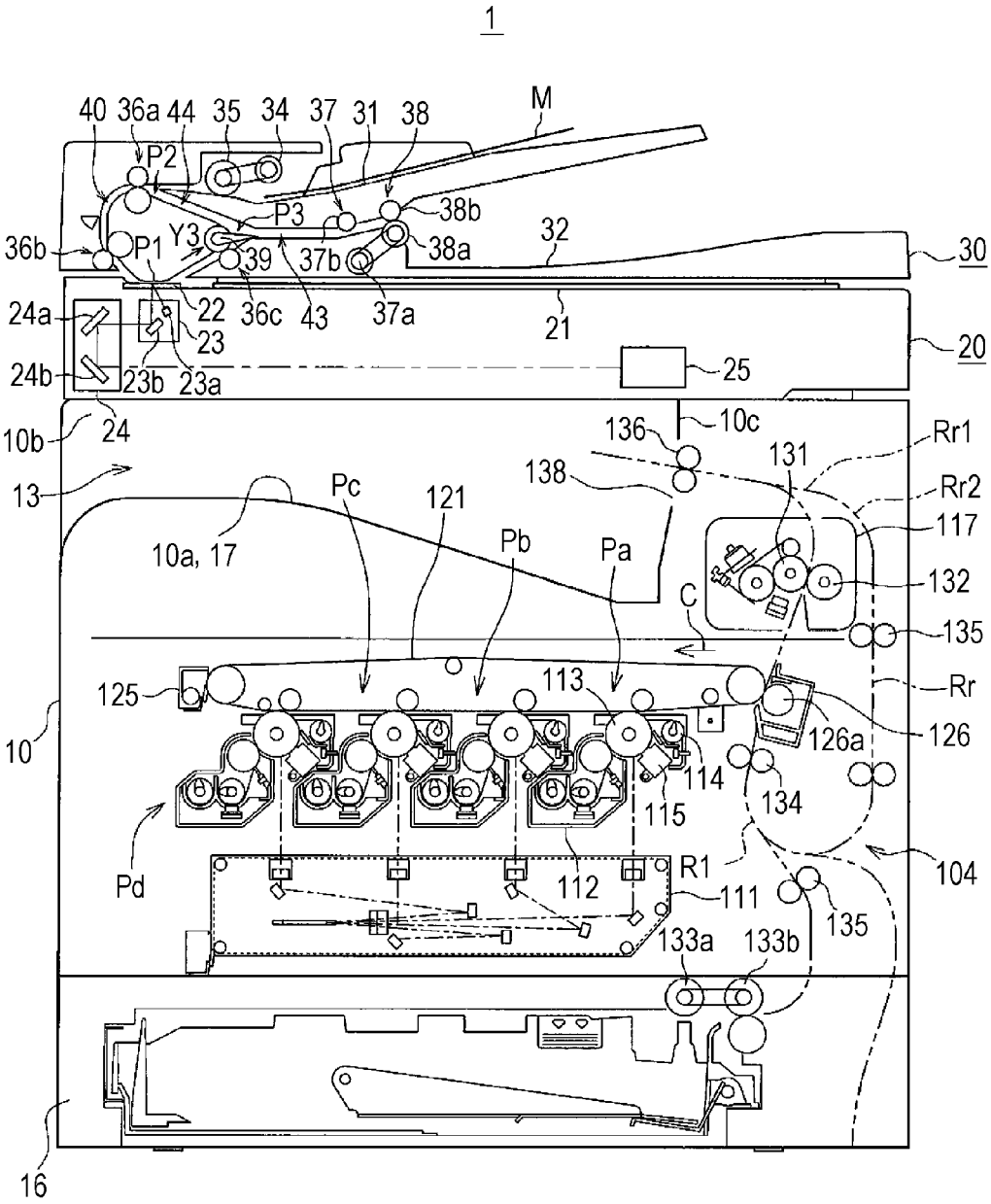
FIG. 1 is a schematic sectional front view of an image forming apparatus according to a first embodiment of the disclosure.

FIG. 1 is a schematic sectional front view of an image forming apparatus 1 according to the first embodiment.

The image forming apparatus 1 shown in FIG. 1 is an in-body sheet discharge type image forming apparatus in which an in-body sheet discharge space section 13 that is C-shaped in cross section is formed between an apparatus body 10 and an image reading housing. The apparatus body 10 includes an image forming unit 104. The image reading housing includes an image reading unit 20 for a document.

The in-body sheet discharge space section 13 includes a space formed by an inner bottom surface 10*a*, inner side surfaces 10*b*, and an inner back surface 10*c* of the apparatus body 10, with a top portion of this space being covered with the image reading unit 20. The inner bottom surface 10*a* of the apparatus body 10 is a sheet-discharge tray 17. Sheet-discharge rollers 136 (described later) are disposed at the inner back surface 10*c*.

A document feeder (ADF) 30 is provided at a top portion of the image reading unit 20. The document feeder 30 is provided such that its near-side portion is openable and closable in up-down directions (that is, openable and closable with respect to the image reading unit 20) with a hinge (not shown) being a rotational center. The hinge is provided at a far-side edge portion of an upper surface of the image reading unit 20.

In the image forming apparatus 1 having such a structure, image data corresponding to color images using black (K), cyan (C), magenta (M), and yellow (Y), or image data corresponding to a monochrome image using a single color (such as black), is handled. Four developing devices 112 for forming four types of toner images, four photoconductor drums 113, four cleaning devices 114, and four chargers 115 are provided at the image forming unit 104 in correspondence with black, cyan, magenta, and yellow. Accordingly, four image stations Pa, Pb, Pc, and Pd each including the corresponding developing device 112, the corresponding photoconductor drum 113, the corresponding cleaning device 114, and the corresponding charger 115 are formed.

An intermediate transfer belt 121 is disposed at upper sides of the photoconductor drums 113. The intermediate transfer belt 121 circulates in the direction of arrow C. Residual toner on the intermediate transfer belt 121 is removed and collected by a belt cleaning device 125. Toner images of the respective colors formed on the surfaces of the respective photoconductor drums 113 are successively transferred to the intermediate transfer belt 121 and superposed upon each other, so that a color toner image is formed on an outer surface of the intermediate transfer belt 121.

A nip region is formed between a transfer roller 126*a* of a second transfer device 126 and the intermediate transfer belt 121. The transfer roller 126*a* and the intermediate transfer belt 121 nip and transport a sheet transported to a sheet transport path R1. When the sheet passes through the nip region, the toner image on the outer surface of the intermediate transfer belt 121 is transferred to the sheet, and is transported to a fixing device 117.

The fixing device 117 includes a fixing roller 131 and a pressure roller 132. The sheet to which the toner image has been transferred is nipped between the fixing roller 131 and the pressure roller 132 of the fixing device 117 for heating and pressing the sheet to which the toner image has been transferred, as a result of which the fixing device 117 fixes the toner image to the sheet.

A sheet-feed cassette 16 is provided below a light scanning device 111. A sheet is drawn out from the sheet-feed cassette 16 by a pickup roller 133*a* and a separation roller 133*b*, and is transported to the sheet transport path R1. Then, the sheet passes the second transfer device 126 and the fixing device 117, and is discharged onto the sheet-discharge tray 17 by the sheet-discharge rollers 136 that are provided at a sheet discharging unit 138. Register rollers 134, transport rollers 135, and the sheet-discharge rollers 136 are disposed at the sheet transport path R1.

When an image is to be formed on the back surface of the sheet, the sheet is transported in the reverse direction to a reverse path Rr from the sheet-discharge rollers 136, has its front and back surfaces reversed, is guided again to the register rollers 134, so that an image is formed on the back surface of the sheet in the same way that the image is formed on the front surface of the sheet. Then, the sheet is transported to the sheet-discharge tray 17.

Description of Image Reading Unit 20

The image reading unit 20 includes a document table glass 21, a document read glass 22, a light source unit 23, a mirror unit 24, and an image pickup unit 25.

The light source unit 23 includes a light source 23*a* that emits light towards a document M and a mirror 23*b* that guides light reflected from the document M towards the mirror unit 24. The mirror unit 24 includes a mirror 24*a* and a mirror 24*b*. The image pickup unit 25 includes, for example, a condensing lens and a charge coupled device (CCD).

Although not described in detail, the image reading unit 20 has a structure that allows it to perform document fixed reading and document moving reading.

Description of Document Feeder 30

Figure 2:
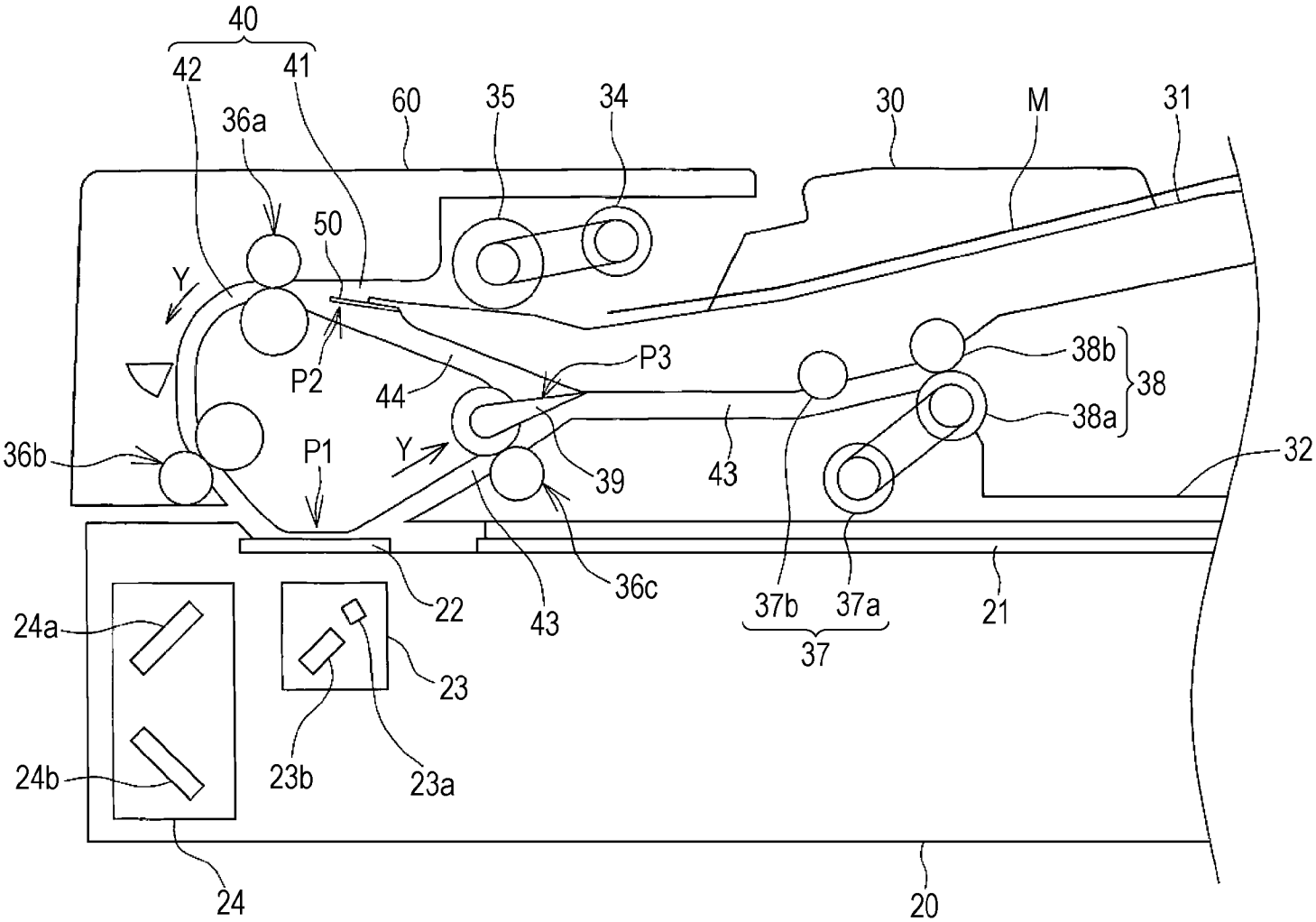
FIG. 2 is an enlarged schematic sectional view of transport paths.

FIG. 2 is an enlarged schematic sectional view of transport paths of the document feeder 30.

The document feeder 30 includes a document tray 31, a discharge tray 32, a principal path 40, an auxiliary transport path 43, and a reverse transport path 44. A document (sheet) M is placed on the document tray 31. The document M is discharged onto the discharge tray 32. The principal path 40 allows the document M placed on the document tray 31 to be transported from the document tray 31 to a reading position P1. The auxiliary path 43 allows the document M transported to the reading position P1 to be transported to the discharge tray 32. The reverse transport path 44 allows the document M that has passed the reading position P1 to return to the principal transport path 40. The reading position P1 is a position irradiated with light from the light source 23*a* via the document read glass 22.

A pickup roller 34 is provided near the document tray 31. The pickup roller 34 is provided for allowing the principal transport path 40 to successively take in documents M on the document tray 31 from a topmost document M.

A separation roller 35 is provided near the pickup roller 34. The separation roller 35 is provided for not allowing a plurality of documents M to be transported in a superposed state to the principal transport path 40 (that is, not allowing multi-feeding).

The principal transport path 40 includes a curved transport path 42 that is U-shaped in front view. More specifically, the principal transport path 40 is formed so as to turn back towards the reading position P1 from the document tray 31 via a linear transport path 41 and the curved transport path 42.

The auxiliary transport path 43 is formed so as to extend downstream in a sheet transport direction Y from the reading position P1 (that is, to extend towards the discharge tray 32). The reverse transport path 44 is provided between the principal transport path 40 and the auxiliary transport path 43, and is a path extending from a merging section P2 (where the reverse transport path 44 merges with the linear transport path 41 of the principal transport path 40) to a merging section P3 (where the reverse transport path 44 merges with the auxiliary transport path 43). That is, the curved transport path 42 of the principal transport path 40, the auxiliary transport path 43, and the reverse transport path 44 form a circulation path. The auxiliary transport path 43 that is provided between the merging section P3 and the discharge tray 32 functions as a switch-back path for switching between a leading end and a trailing end of the document M in the sheet transport direction Y.

A transport roller pair 36*a* and a transport roller pair 36*b* are provided at the principal transport path 40. A transport roller pair 36*c*, a transport roller pair 37, and a discharge roller pair 38 are provided at the auxiliary transport path 43.

The transport roller pair 37 and the discharge roller pair 38 are disposed between the merging section P3 and the discharge tray 32.

The transport roller pair 37 includes a drive roller 37*a* and a driven roller 37*b*. The discharge roller pair 38 includes a drive roller 38*a* and a driven roller 38*b*.

A claw member 39 is provided near the merging section P3. The claw member 39 is formed such that, when the document M is transported in the interior of the auxiliary transport path 43 in the sheet transport direction Y, the claw member 39 is pushed up by the document M to open the auxiliary transport path 43.

The overall structure of the image forming apparatus 1 is as described above.

In the first embodiment, since the sheet transporting device according to the disclosure is installed in the document feeder 30, the document feeder 30 is described in more detail.

Figure 3:
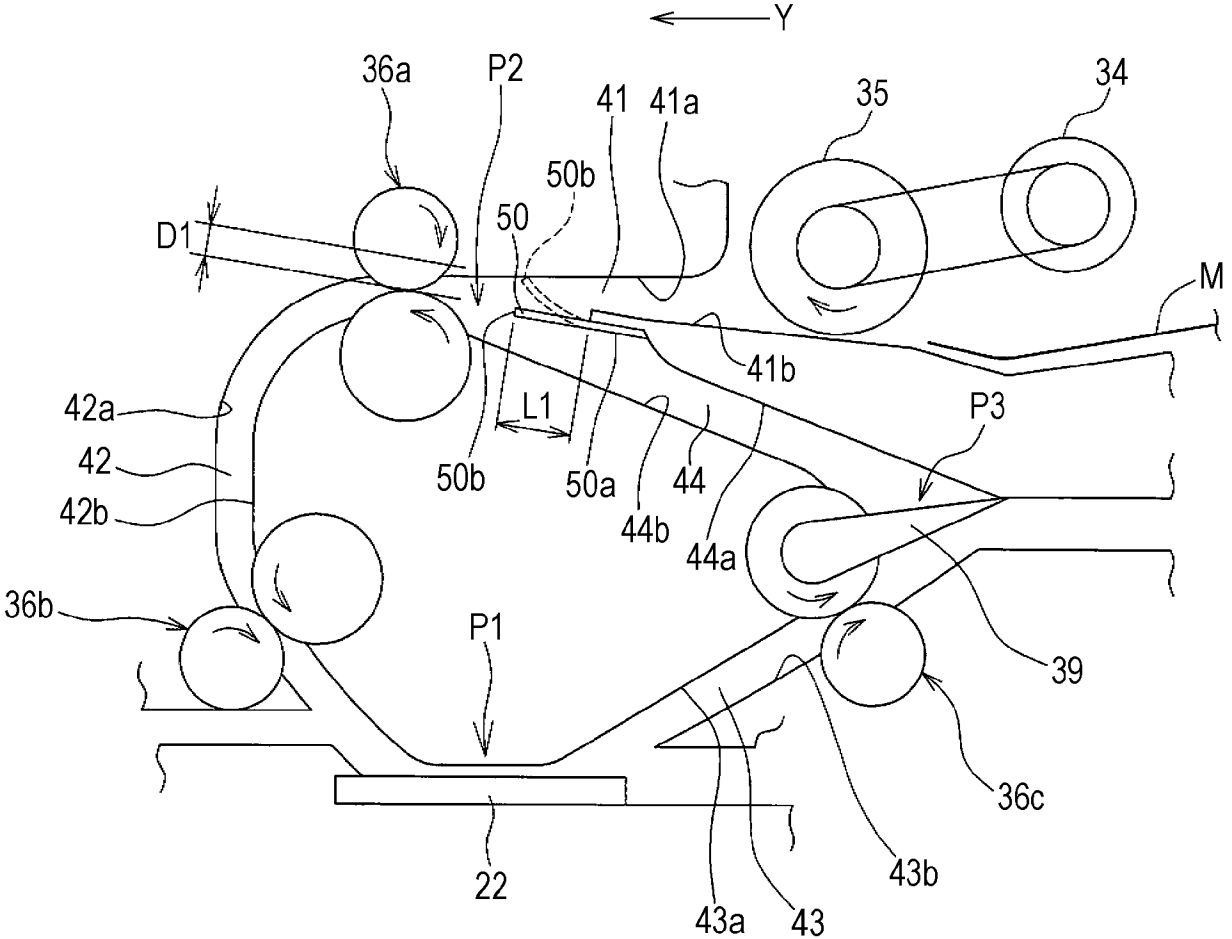
FIG. 3 is a further enlarged schematic sectional view of a principal transport path and a reverse transport path among the transport paths.
Figure 4:
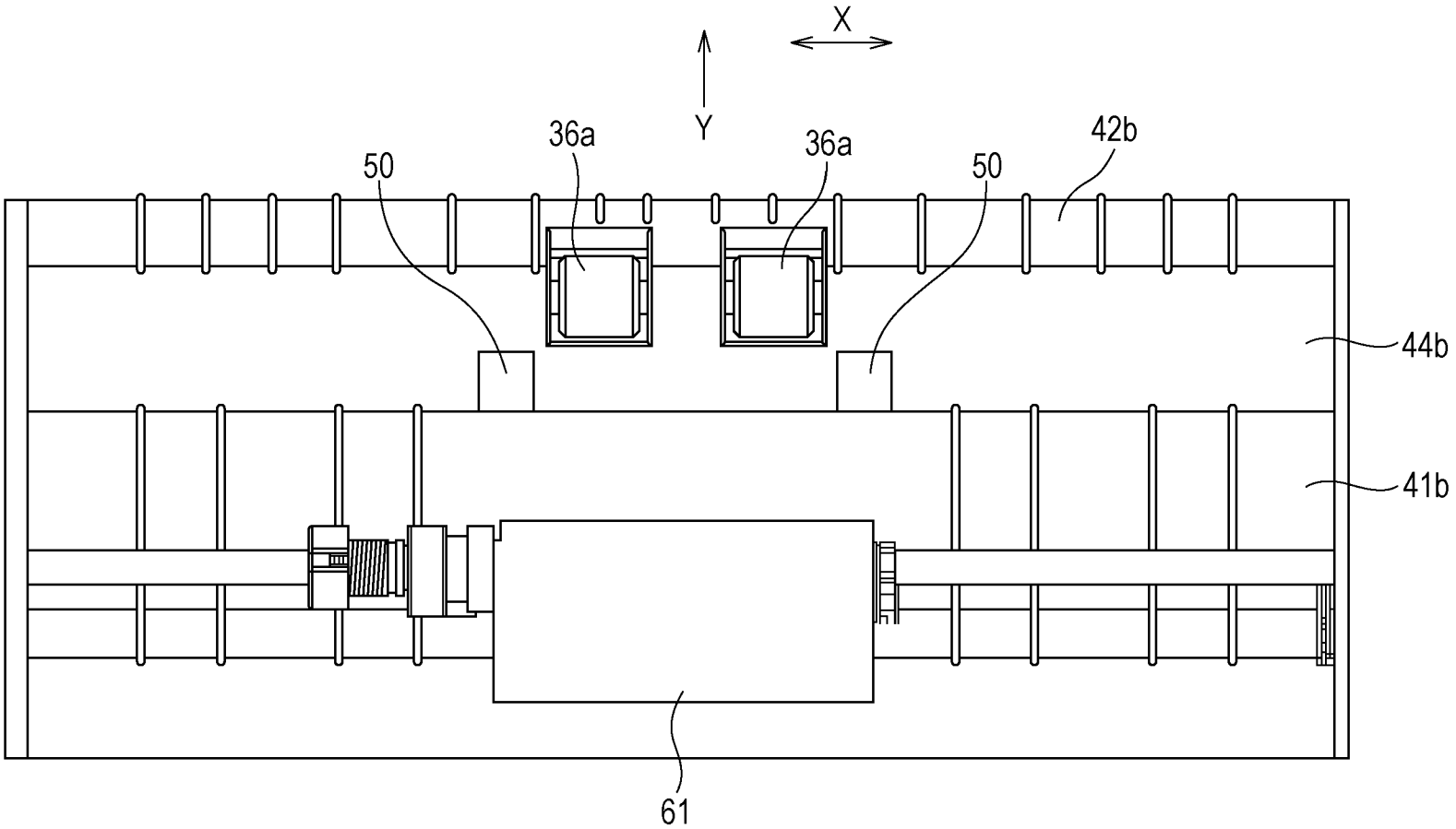
FIG. 4 is an enlarged schematic plan view of the principal transport path and the reverse transport path.

FIG. 3 is a further enlarged schematic sectional view of the principal transport path 40 and the reverse transport path 44. FIG. 4 is an enlarged schematic plan view of the principal transport path 40 and the reverse transport path 44. FIG. 4 shows a state in which an upper cover 60 shown in FIG. 2 is opened and removed. Reference numeral 61 in FIG. 4 denotes a roller unit including the pickup roller 34 and the separation roller 35 that are integrated into one unit.

Each transport path is basically formed by a pair of transport guides that are in the form of plates. That is, the linear transport path 41 of the principal transport path 40 is formed by a pair of linear transport guides 41*a* and 41*b* that oppose each other in the up-down directions. The curved transport path 42 of the principal transport path 40 is formed by a pair of curved transport guides 42*a* and 42*b* that oppose each other in left-right directions. The auxiliary transport path 43 is formed by a pair of auxiliary transport guides 43*a* and 43*b* that oppose each other in the up-down directions. The reverse transport path 44 is formed by a pair of reverse transport guides 44*a* and 44*b* that oppose each other in the up-down directions.

That is, the curved transport path 42 is disposed downstream in the sheet transport direction Y from the merging section P2 where the linear transport path 41 and the reverse transport path 44 merge with each other. When viewed from the opposite side, the transport paths that are disposed upstream in the sheet transport direction Y from the merging section P2 include the linear transport path 41 (formed by the pair of linear transport guides 41*a* and 41*b*) and the reverse transport path 44 (formed by the pair of reverse transport guides 44*a* and 44*b*).

That is, in the first embodiment, an upper transport guide that forms one of the transport paths in the claims corresponds to the linear transport guide 41*a* at the upper side of the linear transport path 41, and an intermediate transport guide that forms the one of the transport paths corresponds to the linear transport guide 41*b* at the lower side of the linear transport path 41. Similarly, a lower transport guide that forms another one of the transport paths corresponds to the reverse transport guide 44*b* at the lower side of the reverse transport path 44, and an intermediate transport guide that forms the another one of the transport paths corresponds to the reverse transport guide 44*a* at the upper side of the reverse transport path 44.

That is, the linear transport guide (intermediate transport guide) 41*b* at the lower side of the linear transport path 41 and the reverse transport guide (intermediate transport guide) 44*a* at the upper side of the reverse transport path 44 are integrated into a wedge shape (triangular shape) in front view.

In such a structure, in the first embodiment, in order to reduce jumping up of a trailing end portion of a document (sheet) M occurring when the document M passing the merging section P2 and moving towards the curved transport path 42 is flexed into a U shape, sheet guide members 50 are provided at the merging section P2.

Each sheet guide member 50 includes a base end portion 50*a* to which the reverse transport guide (intermediate transport guide) 44*a* (at the upper side of the reverse transport path 44 that merges at the merging section P2) is fixed. An end portion 50*b* side of each sheet guide member 50 extends in the interior of the merging section P2 towards the curved transport path 42. That is, the base end portion 50*a* of each sheet guide member 50 is secured to the upper reverse transport guide (intermediate transport guide) 44*a* against which the trailing end portion of the sheet is pressed due to jumping up of the sheet when the sheet that is transported in the interior of the reverse transport path 44 is flexed. By securing the base end portion 50*a* of each sheet guide member 50 to the upper reverse transport guide (intermediate transport guide) 44*a*, the direction in which the trailing end portion of the document (sheet) M jumps up becomes the same as the direction in which the base end portion 50*a* of each sheet guide member 50 is pushed against the reverse transport guide (intermediate transport guide) 44*a*. Therefore, for example, when the base end portion 50*a* of each sheet guide member 50 is bonded with an adhesive, it is possible to suppress a reduction in the adhesive strength (that is, not to allow the coming off of the adhesive).

The end portion 50*b* of each extending sheet guide member 50 is disposed so as not to contact the transport guides in the merging section P2 (more specifically, the linear transport guide 41*a* at the upper side of the linear transport path 41 and the reverse transport guide 44*b* at the lower side of the reverse transport path 44. In order not to hinder the passage, itself, of the document M that is transported through each of the transport paths 41 and 44, the end portion 50*b* of each sheet guide member 50 is disposed apart from the linear transport guide 41*a* at the upper side of the linear transport path 41 and the reverse transport guide 44*b* at the lower side of the reverse transport path 44 by certain distances therefrom. By disposing the end portion 50*b* of each sheet guide member 50 so as not to contact the transport guides in the merging section P2, the passage, itself, of the document M is not hindered. Therefore, it is possible not to allow, for example, a sheet jam.

Here, each sheet guide member 50 is a small sheet member that is flexible and that is square-shaped. In the first embodiment, as shown in FIG. 4, two sheet guide members 50 are symmetrically disposed in a sheet width direction X that is orthogonal to the sheet transport direction Y. The gap between the sheet guide members 50 is slightly smaller than the width of a smallest document that can be transported by the document feeder 30. This makes it possible to reliably hold down the trailing end portion of a document of any size.

As the flexible sheet member, a resin film formed of, for example, PET, nylon, ABS, PBT, PPS, POM, or LCP may be used as appropriate. Though the thickness of the resin film depends upon the type of resin, it is desirable that the thickness of the resin film be on the order of 0.1 mm.

However, each sheet guide member 50 needs to be flexible enough to be sufficiently flexed by a jumping-up force of the trailing end portion of the document M that is generated when the document (sheet) M passing through the merging section P2 and moving towards the curved transport path 42 is flexed into a U shape.

By mounting the sheet guide members 50 formed of such a material to the reverse transport guide 44*a* at the upper side of the reverse transport path 44, it is possible to guide the document M to the curved transport path 42 from the reverse transport path 44 while reducing the jumping up of the trailing end portion of the document M by the flexing force of the sheet guide members 50.

Here, a protruding length L1 of each sheet guide member 50 may be a length that allows each end portion 50*b* to contact the transport guide 41*a* at the upper side of the linear transport path 41 when the corresponding sheet guide member 50 is maximally flexed (that is, in the state shown by a broken line in FIG. 3) by the jumping up of the trailing end portion of the document M. However, each end portion 50*b* need not contact the transport guide 41*a*. That is, the protruding length L1 of each sheet guide member 50 may be a length that allows the corresponding end portion 50*b* to be flexed up to a location near the transport guide 41*a*. By this, when the trailing end portion of the document M is separated from the end portions 50*b* of the sheet guide members 50, the trailing end portion of the document M does not strongly jump up, and, thus, can move smoothly from the end portions 50*b* of the flexed sheet guide members 50 to the linear transport guide 41*a* at the upper side of the linear transport path 41 and contact the linear transport guide 41*a*.

That is, at the merging section P2, there is a large height difference D1 between the transport guide 44*a* at the upper side of the reverse transport path 44 and the transport guide 41*a* at the upper side of the linear transport path 41. However, when the jumping up of the trailing end portion of the document M caused by the height difference D1 is eliminated or reduced, it is possible to reduce or eliminate a striking sound generated when the trailing end portion of the document jumps up and strikes the upper linear transport guide 41*a*.

Figure 5:
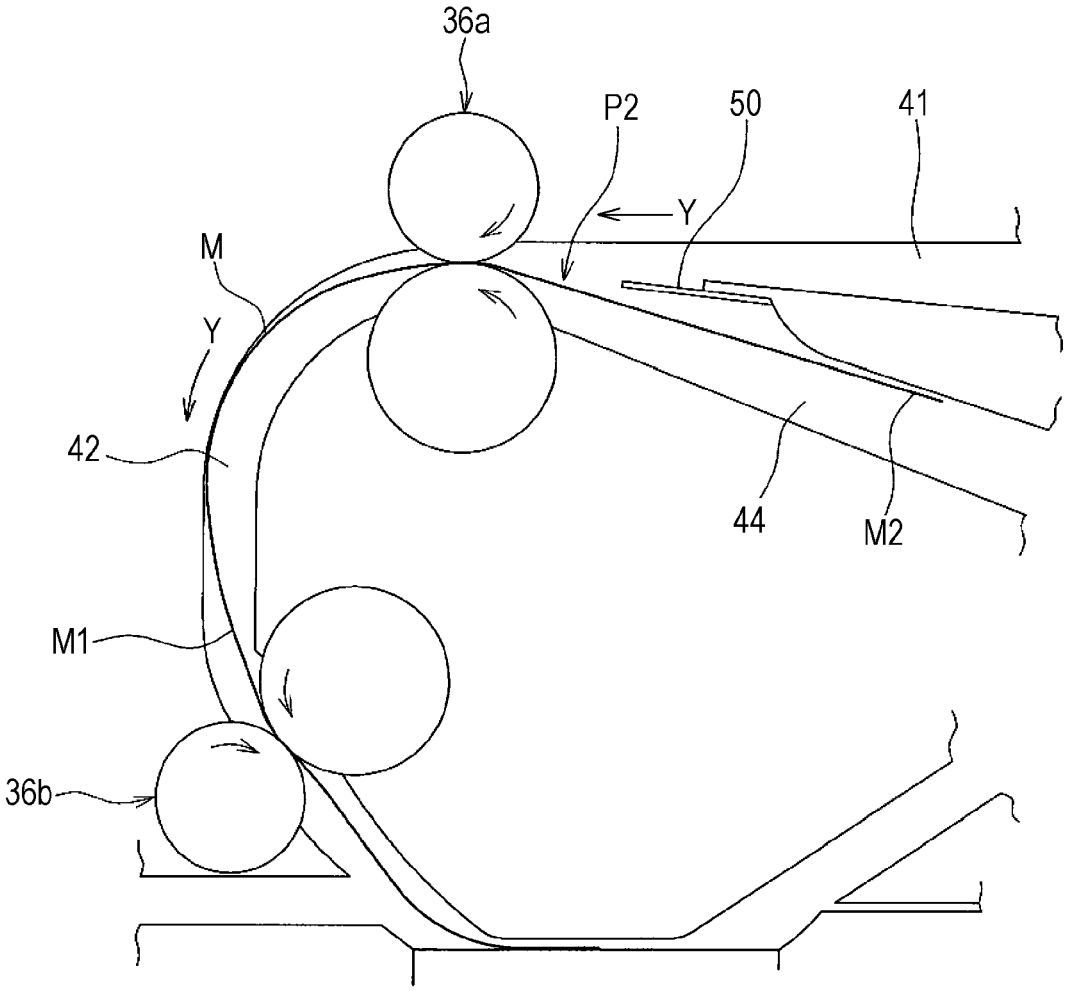
FIG. 5 is an enlarged schematic plan view of a merging section where the principal transport path and the reverse transport path merge with each other, and shows a state when a trailing end portion of a document passes the merging section.
Figure 6:
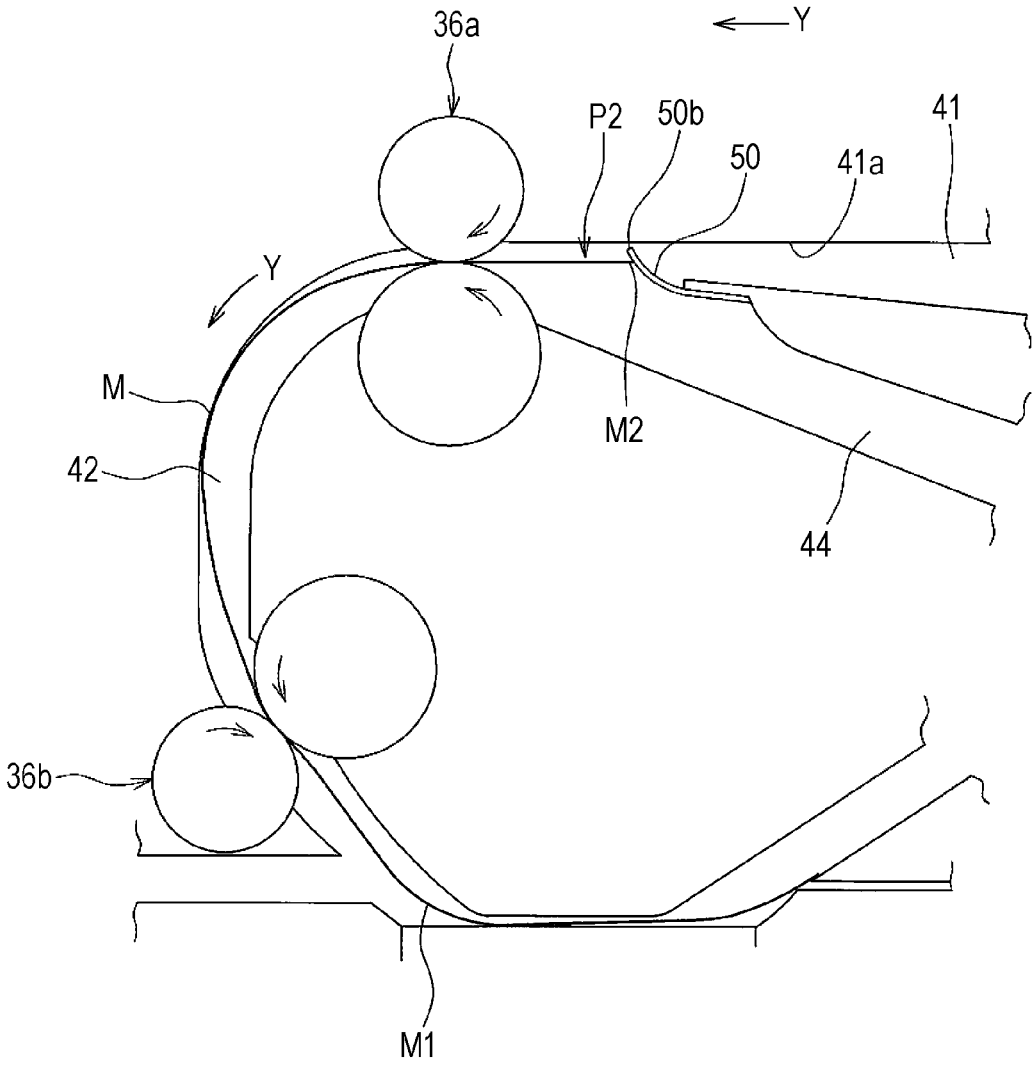
FIG. 6 is an enlarged schematic plan view of the merging section where the principal transport path and the reverse transport path merge with each other, and shows a state when the trailing end portion of the document passes the merging section.

FIGS. 5 and 6 are each an enlarged schematic plan view of the merging section where the principal transport path and the reverse transport path merge with each other, and shows a state when the trailing end portion M2 of the document M passes the merging section P2.

That is, the document M that is transported to the curved transport path 42 from the merging section P2 via the reverse transport path 44 is such that a leading end portion M1 is transported into the curved transport path 42 before the trailing end portion M2 passes the merging section P2. Therefore, the document M in this state of transport is put into a state in which the leading end portion M1 is curved (flexed) into a U shape by the curved transport path 42 (see FIG. 5).

When, in this state, the trailing end portion M2 of the document M moves to the merging section P2 from the reverse transport path 44, as shown in FIG. 6, the sheet guide members 50 are gradually flexed towards the transport guide 41*a* at the upper side of the linear transport path 41 by the jumping-up force of the trailing end portion M2 generated by the flexing of the document M into the U shape. Then, when the trailing end portion M2 of the document M is gradually raised along the sheet guide members 50, the jumping-up force of the trailing end portion M2 of the document M is also reduced.

When the trailing end portion M2 of the document M is completely separated from the sheet guide members 50 (FIG. 6 shows a state just before the trailing end portion M2 is completely separated from the sheet guide members 50), the jumping-up force of the trailing end portion M2 is also sufficiently reduced, and the trailing end portion M2 of the document M is close to (or is in contact with) the transport guide 41*a* at the upper side of the linear transport path 41. Therefore, even if the trailing end portion M2 of the document M in this state is separated from the sheet guide members 50, the trailing end portion M2 of the document M does not strongly strike the transport guide 41*a* at the upper side of the linear transport path 41.

Therefore, it is possible to reliably prevent or reduce the occurrence of a striking sound that is generated when the trailing end portion M2 of the document M strongly strikes the transport guide 41*a* at the merging section P2.

In the example shown in FIG. 4, two sheet guide members 50, which are small square sheet members, are symmetrically provided in the sheet width direction X. However, for example, one sheet guide member may be provided at a central portion in the sheet width direction X, or a plurality of sheet guide members (such as four or six sheet guide members) may be provided in correspondence with the size of the document.

Second Embodiment

Although, in the first embodiment, the sheet guide members 50 are small square sheet members, in a second embodiment, one long sheet member is used as a sheet guide member 50.

Figure 7:
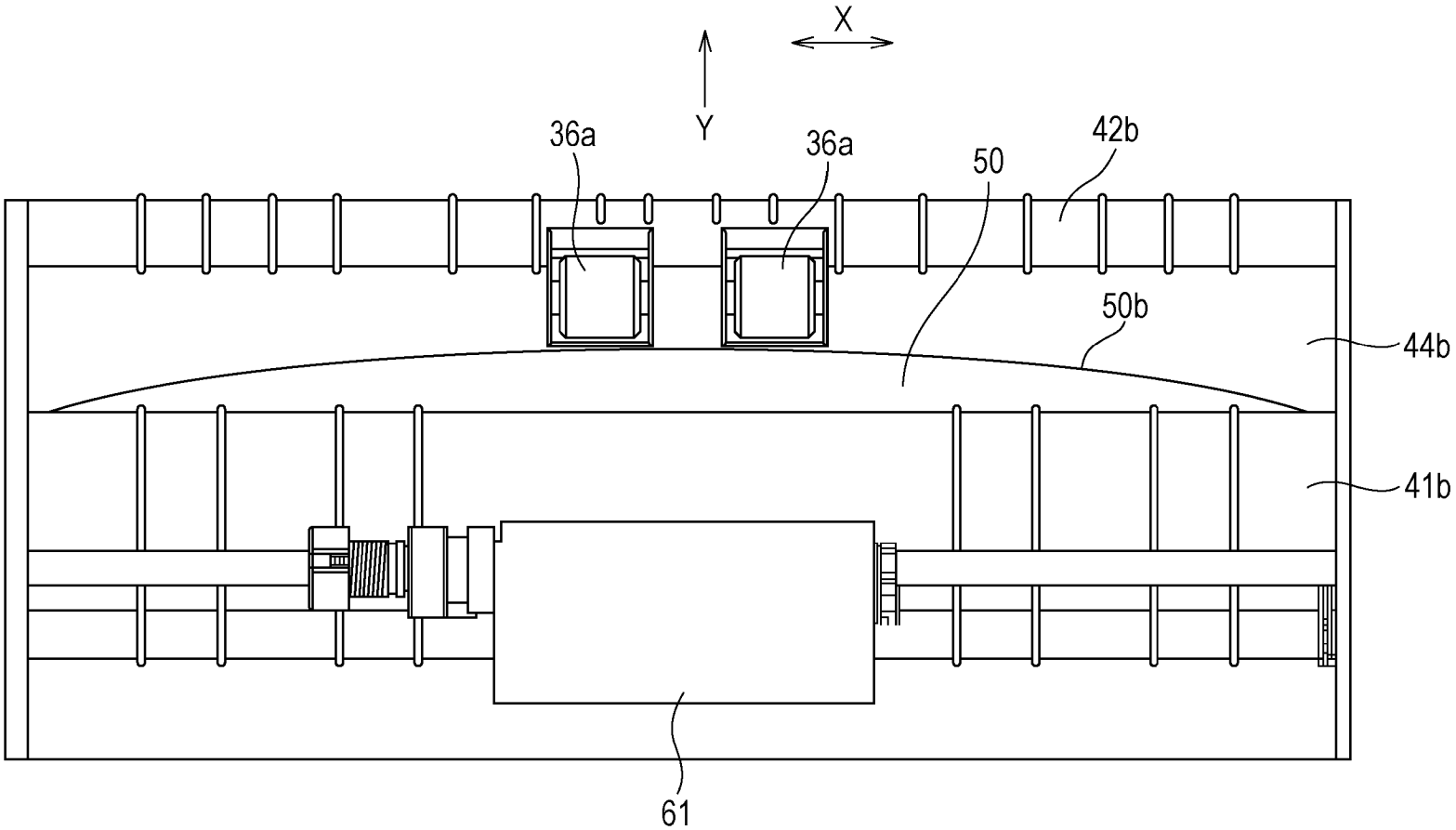
FIG. 7 shows a sheet guide member according to a second embodiment, and is an enlarged schematic plan view of a principal transport path and a reverse transport path.

FIG. 7 shows the sheet guide member 50 according to the second embodiment, and is an enlarged schematic plan view of a principal transport path and a reverse transport path 44.

In the sheet guide member 50 shown in FIG. 7, an end portion 50*b* is nonlinear along a sheet width direction X. More specifically, the entire end portion 50*b* is gently curved such that a central portion in the sheet width direction X protrudes in a sheet transport direction Y. In this case, the sheet guide member 50 may be a flexible resin film. However, since the sheet guide member 50 has a characteristic shape, the sheet guide member 50 need not be flexible.

According to this structure, when a trailing end portion M2 of a document M moves to a merging section P2 from the reverse transport path 44, the entire trailing end portion M2 of the document M is not separated from the sheet guide member 50 at the same time, that is, the trailing end portion M2 of the document M can be gradually separated from the sheet guide member 50 at different timings.

Figure 8:
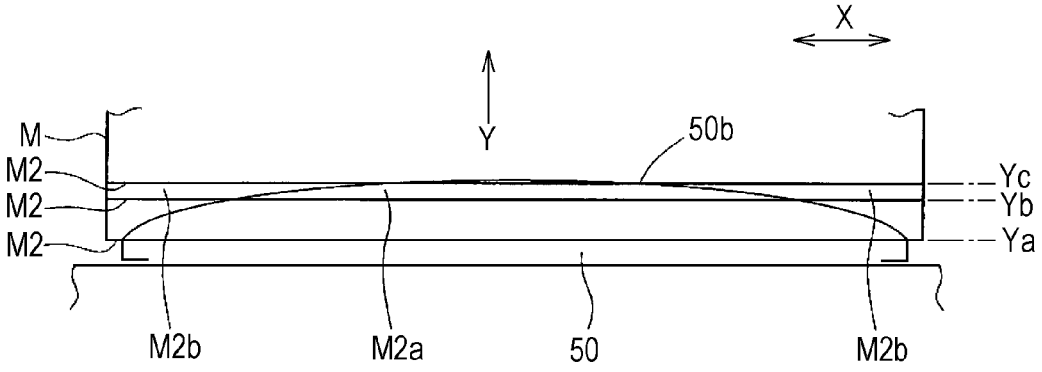
FIG. 8 is a schematic explanatory view of a state when a trailing end portion of a document moves to a merging section from the reverse transport path.

FIG. 8 is a schematic explanatory view of a state when the trailing end portion M2 of the document M moves to the merging section P2 from the reverse transport path 44.

That is, when the trailing end portion M2 of the document M is at a position Ya in the sheet transport direction Y, the entire trailing end portion M2 is held down by the sheet guide member 50.

Next, when the trailing end portion M2 of the document M moves slightly from this position and arrives at a position Yb in the sheet transport direction Y, the trailing end portion M2 of the sheet M is such that its central portion M2*a* in the sheet width direction X is held down by the sheet guide member 50, and such that two outer side portions M2*b* in the sheet width direction D are separated from the end portion 50*b* of the sheet guide member 50. At this time, the two outer side portions M2*b* in the sheet width direction X of the trailing end portion M2 of the sheet M are put in a slightly jumped-up state by the jumping-up force of the trailing end portion M2 generated by the flexing of the document M into a U shape. However, with this jumping-up amount, the outer side portions M2*b* do not strike a linear transport guide 41*a* at the upper side of a linear transport path 41, as a result of which a striking sound is not generated.

Next, when the trailing end portion M2 of the document M moves a little further from this position and arrives at a position Yc in the sheet transport direction Y, the trailing end portion M2 of the document M is such that only the central portion in the sheet width direction X is slightly held down by the sheet guide member 50, and such that large portions of two outer sides in the sheet width direction X are separated from the end portion 50*b* of the sheet guide member 50. At this time, portions other than the central portion in the sheet width direction X of the trailing end portion M2 of the sheet M are put in a slightly jumped-up state by the jumping-up force of the trailing end portion M2 generated by the flexing of the document M into a U shape. However, the central portion of the trailing end portion M2 is still held down, so that the jumping-up force is weak, as a result of which the portions of the trailing end portion M2 other than the central portion of the trailing end portion M2 do not jump up by an amount that causes them to strike the linear transport guide 41*a* at the upper side of the linear transport path 41. Besides, even if they strike the linear transport guide 41*a*, they do not strongly strike the linear transport guide 41*a*. Therefore, even in this state, a striking sound is not generated.

Thereafter, when the trailing end portion M2 of the document M passes the position Yc in the sheet transport direction Y, the central portion of the trailing end portion M2 of the sheet M also jumps up. However, since the other portions of the trailing end portion M2 have already jumped up, the jumping-up force of the central portion of the trailing end portion M2 is also reduced. Therefore, the central portion of the trailing end portion M2 does not jump up so much. Consequently, the trailing end portion M2 of the document M does not strongly strike the linear transport guide 41*a* at the upper side of the linear transport path 41. Thus, a striking sound is not generated, or even if a striking sound is generated, it is sufficiently reduced.

In this way, according to the sheet guide member 50 having the shape shown in FIG. 7, the jumping-up force that is generated when the trailing end portion M2 of the document M moves to the merging section P2 from the reverse transport path 44 is gradually reduced at different timings in accordance with the shape of the end portion 50*b* of the sheet guide member 50. Therefore, the trailing end portion M2 of the document M that has moved into the merging section P2 from the reverse transport path 44 does not strongly strike the linear transport guide 41*a* at the upper side of the merging section P2 when the trailing end portion M2 jumps up. Consequently, it is possible to reduce or eliminate a striking sound generated when the trailing end portion M2 of the document M jumps up and strikes the upper linear transport guide 41*a*.

Although, in the second embodiment, the sheet guide member 50 is described as not being flexible, the sheet guide member 50 may be flexible. This makes it possible to expect a combination of the effects according to the second embodiment and the effect of reducing the jumping-up force of the trailing end portion M2 of the document M by the flexing of the sheet guide members 50 described in the first embodiment.

Third Embodiment

In a third embodiment, as in the second embodiment, a long sheet member is used as a sheet guide member 50.

Figure 9:
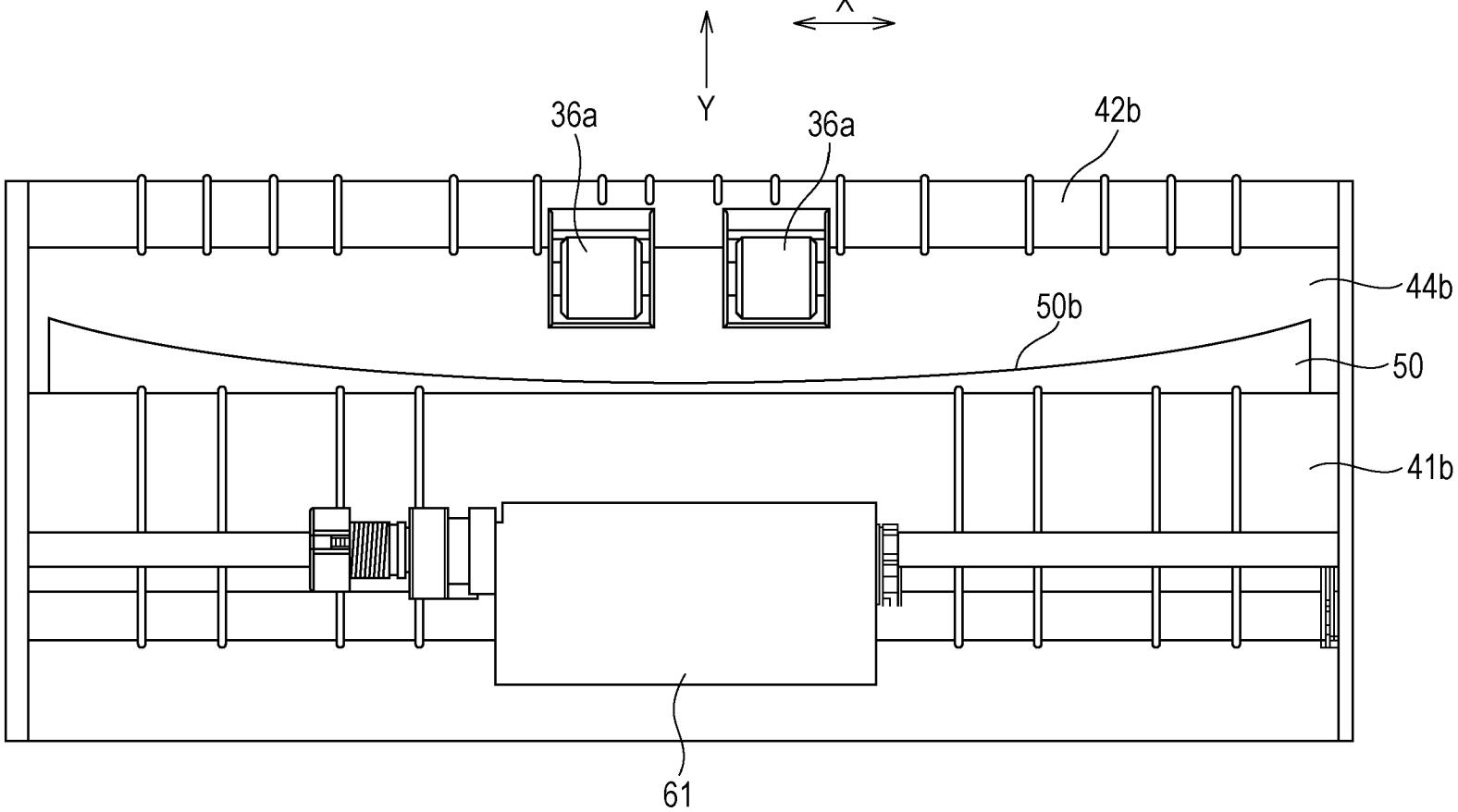
FIG. 9 shows a sheet guide member according to a third embodiment, and is an enlarged schematic plan view of a principal transport path and a reverse transport path.

FIG. 9 shows the sheet guide member 50 according to the third embodiment, and is an enlarged schematic plan view of a principal transport path and a reverse transport path 44.

In the sheet guide member 50 shown in FIG. 9, an end portion 50*b* is nonlinear along a sheet width direction X. More specifically, the entire end portion 50*b* is gently curved such that a central portion in the sheet width direction X is recessed in a direction opposite to a sheet transport direction Y (that is, towards an upstream side in the sheet transport direction Y). In this case, the sheet guide member 50 may be a flexible resin film. However, since the sheet guide member 50 has a characteristic shape, the sheet guide member 50 need not be flexible.

According to this structure, when a trailing end portion M2 of a document M moves to a merging section P2 from the reverse transport path 44, the entire trailing end portion M2 of the document M is not separated from the sheet guide member 50 at the same time, that is, the trailing end portion M2 of the document M can be gradually separated from the sheet guide member 50 at different timings.

Figure 10:
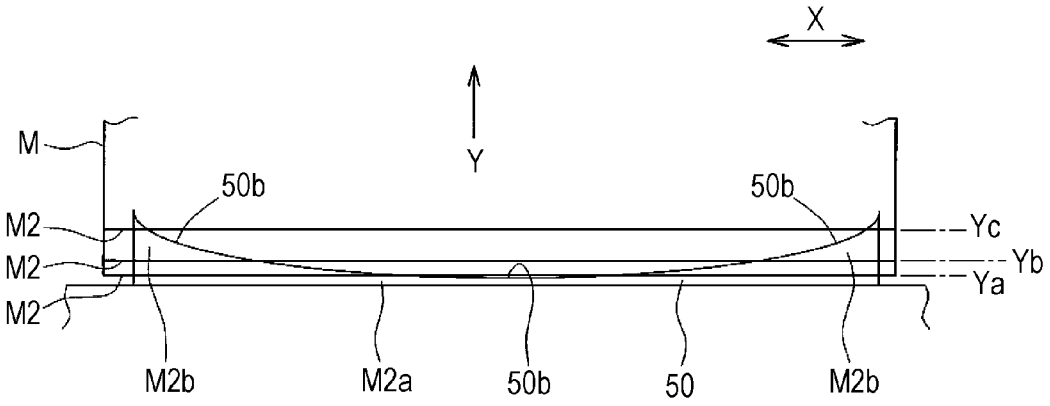
FIG. 10 is a schematic explanatory view of a state when a trailing end portion of a document moves to a merging section from the reverse transport path.

FIG. 10 is a schematic view of a state when the trailing end portion M2 of the document M moves to the merging section P2 from the reverse transport path 44.

That is, when the trailing end portion M2 of the document M is at a position Ya in the sheet transport direction Y, the entire trailing end portion M2 is held down by the sheet guide member 50.

Next, when the trailing end portion M2 of the document M moves slightly from this position and arrives at a position Yb in the sheet transport direction Y, the trailing end portion M2 of the sheet M is such that its central portion M2*a* in the sheet width direction X is separated from the end portion 50*b* of the sheet guide member 50 and slightly bulged, and such that two outer side portions M2*b* in the sheet width direction X are held down by the end portion 50*b* of the sheet guide member 50. At this time, the central portion M2*a* of the trailing end portion M2 of the sheet M is put in a slightly upwardly bulging state by the jumping-up force of the trailing end portion M2 generated by the flexing of the document M into a U shape. However, the two outer side portions M2*b* in the sheet width direction X are still held down by the sheet guide member 50. Therefore, with this bulging amount, the central portion M2*a* does not strike a linear transport guide 41*a* at the upper side of a linear transport path 41, as a result of which a striking sound is not generated.

Next, when the trailing end portion M2 of the document M moves a little further from this position and arrives at a position Yc in the sheet transport direction Y, the trailing end portion M2 of the document M is such that only two end portions in the sheet width direction X are slightly held down by the sheet guide member 50, and such that portions other than the two end portions (that is, a large portion including the central portion in the sheet width direction) are separated from the end portion 50*b* of the sheet guide member 50. At this time, the large portion of the trailing end portion M2 of the sheet M excluding the two end portions thereof is put in a slightly upwardly bulging state by the jumping-up force of the trailing end portion M2 generated by the flexing of the document M into a U shape. However, the two end portions are still held down by the sheet guide member 50. Therefore, the bulging force thereof (jumping-up force) is weak, and the large portion is in contact with the linear transport guide 41*a* at the upper side of the linear transport path 41. Therefore, even in this state, a striking sound is not generated.

Thereafter, when the trailing end portion M2 of the document M passes the position Yc in the sheet transport direction Y, the two end portions of the trailing end portion M2 of the sheet M also jump up. However, since the other portions of the trailing end portion M2 have already jumped up (in particular, the central portion of the trailing end portion M2 is already in contact with the linear transport guide 41*a* at the upper side of the linear transport path 41), the jumping-up force of the two end portions of the trailing end portion M2 is also reduced. Therefore, the two end portions of the trailing end portion M2 do not jump up so much. Consequently, the two end portions of the trailing end portion M2 of the document M do not strongly strike the linear transport guide 41*a* at the upper side of the linear transport path 41. Thus, a striking sound is not generated, or even if a striking sound is generated, it is sufficiently reduced.

In this way, according to the sheet guide member 50 having the shape shown in FIG. 9, the jumping-up force that is generated when the trailing end portion M2 of the document M moves to the merging section P2 from the reverse transport path 44 is gradually reduced at different timings in accordance with the shape of the end portion 50*b* of the sheet guide member 50. Therefore, the trailing end portion M2 of the document M that has moved into the merging section P2 from the reverse transport path 44 does not strongly strike the linear transport guide 41*a* at the upper side of the merging section P2 when the trailing end portion M2 jumps up. Consequently, it is possible to reduce or eliminate a striking sound generated when the trailing end portion M2 of the document M jumps up and strikes the upper linear transport guide 41*a*.

Although, in the third embodiment, the sheet guide member 50 is described as not being flexible, the sheet guide member 50 may be flexible. This makes it possible to expect a combination of the effects according to the third embodiment and the effect of reducing the jumping-up force of the trailing end portion M2 of the document M by the flexing of the sheet guide members 50 described in the first embodiment.

Fourth Embodiment

In a fourth embodiment, as in the first embodiment, a small square sheet member is used as a sheet guide member 50. However, the fourth embodiment is a modification of the second embodiment.

Figure 11:
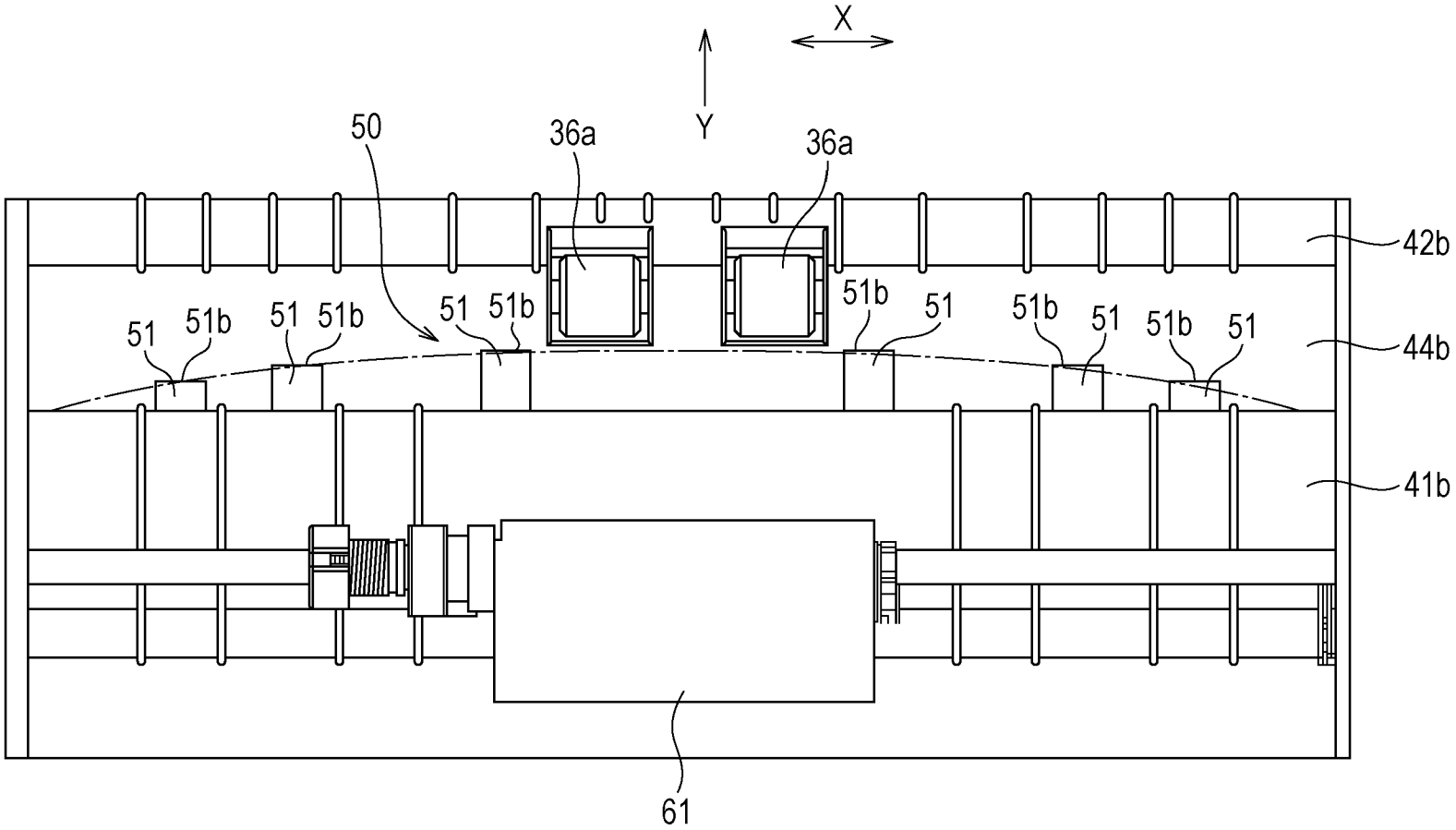
FIG. 11 shows a sheet guide member according to a fourth embodiment, and is an enlarged schematic plan view of a principal transport path and a reverse transport path.

FIG. 11 shows a modification of the sheet guide member 50 according to the second embodiment shown in FIG. 7, and is an enlarged schematic plan view of a principal transport path and a reverse transport path.

The sheet guide member 50 shown in FIG. 7 is integrally formed over the entire length of the sheet guide member 50 in the sheet width direction X. However, the sheet guide member 50 shown in FIG. 11 is divided into a plurality of sheet members 51 (six sheet members 51 in this embodiment) along the sheet width direction X. That is, the sheet guide member 50 shown in FIG. 11 includes the plurality of sheet members 51 disposed in the sheet width direction X, with each sheet member 51 having an end portion 51*b* that is linear along the sheet width direction X and with the end portions 51*b* being disposed so as to have different lengths in a sheet transport direction Y.

More specifically, when the centers (center points) of the end portions 51*b* of the respective sheet members 51 are connected by a curve (indicated by an alternate long and short dashed line in FIG. 11), a gentle curved shape that is the same as that of the end portion 50*b* of the sheet guide member 50 shown in FIG. 7 is formed. Although the end portions 51*b* of the respective sheet members 51 are linear end portions, the end portions 51*b* may be end portions that are curved along the curve indicated by the alternate long and short dashed line in FIG. 11.

In this case, each sheet member 51 may be a flexible resin film. However, since the sheet members 51 each have a characteristic shape, the sheet members 51 need not be flexible.

Although not described in detail here, even the sheet guide member 50 shown in FIG. 11 provides the operational effects that are the same as the above-described operational effects provided by the sheet guide member 50 shown in FIG. 7.

In the fourth embodiment, as in the second embodiment, the case in which the sheet guide member 50 is not flexible is described. However, the sheet guide member 50 may be flexible. This makes it possible to expect a combination of the effects according to the fourth embodiment and the effect of reducing the jumping-up force of the trailing end portion M2 of the document M by the flexing of the sheet guide members 50 described in the first embodiment.

Fifth Embodiment

In a fifth embodiment, as in the first embodiment, a small square sheet member is used as a sheet guide member 50. However, the fifth embodiment is a modification of the third embodiment.

Figure 12:
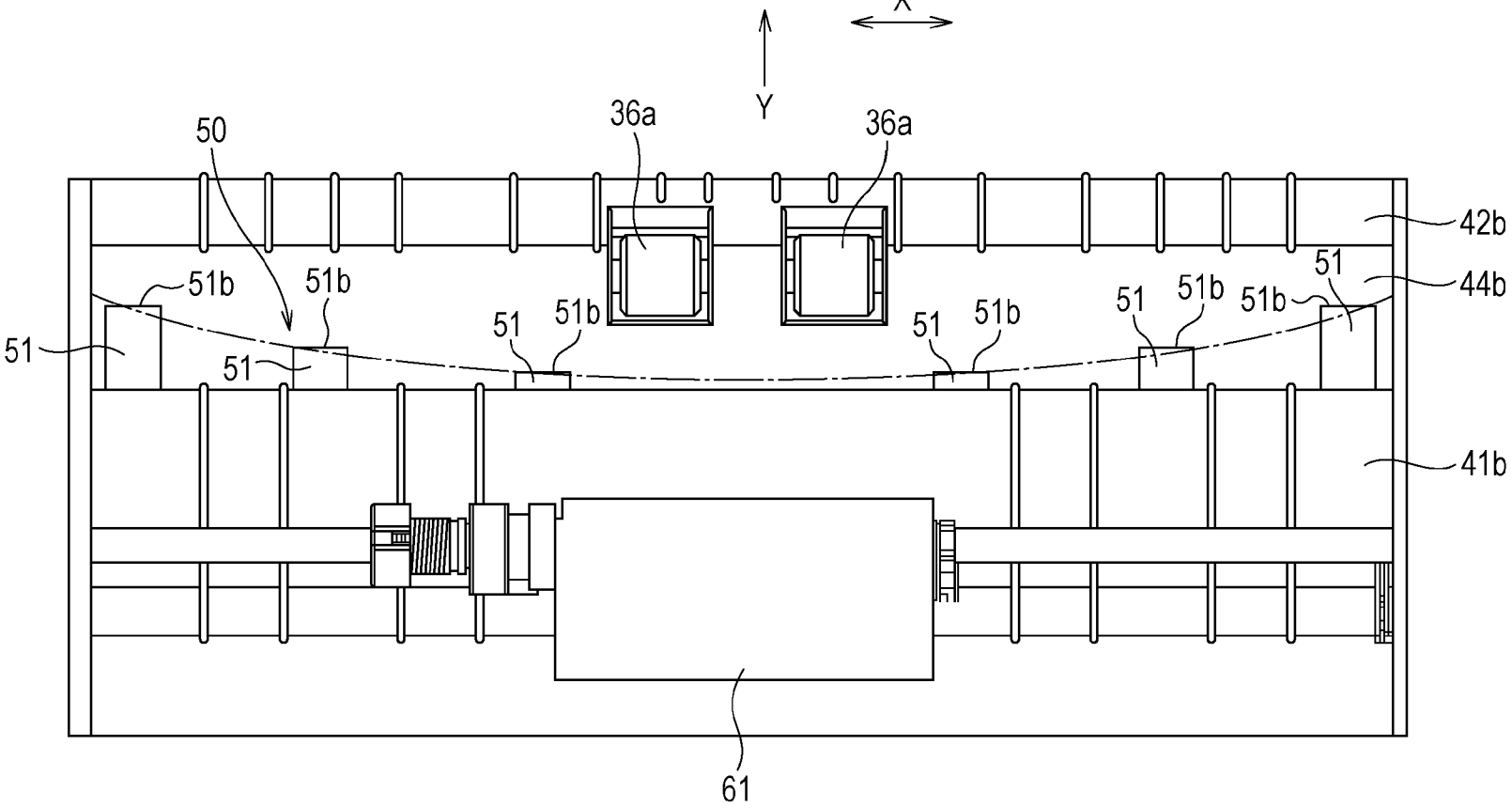
FIG. 12 shows a sheet guide member according to a fifth embodiment, and is an enlarged schematic plan view of a principal transport path and a reverse transport path.

FIG. 12 shows a modification of the sheet guide member 50 according to the third embodiment shown in FIG. 9, and is an enlarged schematic plan view of a principal transport path and a reverse transport path.

The sheet guide member 50 shown in FIG. 9 is integrally formed over the entire length of the sheet guide member 50 in the sheet width direction X. However, the sheet guide member 50 shown in FIG. 12 is divided into a plurality of sheet members 51 (six sheet members 51 in this embodiment) along the sheet width direction X. That is, the sheet guide member 50 shown in FIG. 12 includes the plurality of sheet members 51 disposed in the sheet width direction X, with each sheet member 51 having an end portion 51*b* that is linear along the sheet width direction X and with the end portions 51*b* being disposed so as to have different lengths in a sheet transport direction Y.

More specifically, when the centers (center points) of the end portions 51*b* of the respective sheet members 51 are connected by a curve (indicated by an alternate long and short dashed line in FIG. 12), a gentle curved shape that is the same as that of the end portion 50*b* of the sheet guide member 50 shown in FIG. 9 is formed. Although the end portions 51*b* of the respective sheet members 51 are linear end portions, the end portions 51*b* may be end portions that are curved along the curve indicated by the alternate long and short dashed line in FIG. 12.

In this case, each sheet member 51 may be a flexible resin film. However, since the sheet members 51 each have a characteristic shape, the sheet members 51 need not be flexible.

Although not described in detail here, even the sheet guide member 50 shown in FIG. 12 provides the operational effects that are the same as the above-described operational effects provided by the sheet guide member 50 shown in FIG. 9.

In the fifth embodiment, as in the third embodiment, the case in which the sheet guide member 50 is not flexible is described. However, the sheet guide member 50 may be flexible. This makes it possible to expect a combination of the effects according to the fifth embodiment and the effect of reducing the jumping-up force of the trailing end portion M2 of the document M by the flexing of the sheet guide members 50.

Sixth Embodiment

A sixth embodiment is a modification of the second embodiment.

Figure 13:
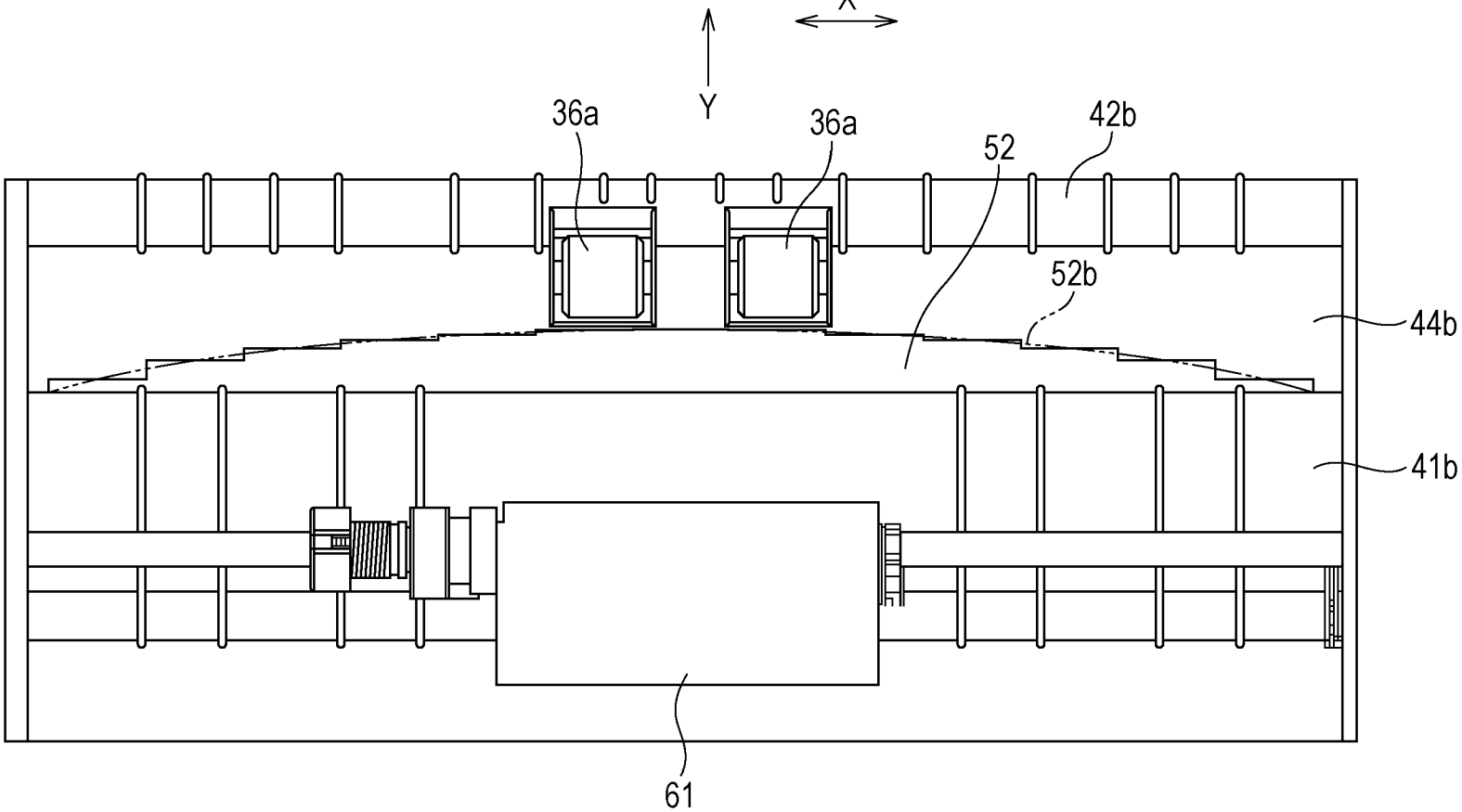
FIG. 13 shows a sheet guide member according to a sixth embodiment, and is an enlarged schematic plan view of a principal transport path and a reverse transport path.

FIG. 13 shows a sheet guide member 52 according to the sixth embodiment, and is an enlarged schematic plan view of a principal transport path and a reverse transport path 44.

In the sheet guide member 52 shown in FIG. 13, an end portion 52*b* is nonlinear along a sheet width direction X. More specifically, the sheet guide member 52 is formed so as to have stepped form from a central portion to two outer sides thereof along the sheet width direction X. Here, in the sixth embodiment, the central portion is formed so as to protrude in a sheet transport direction Y. Although, in FIG. 13, a side of each stepped portion along the sheet width direction X is linear, it may be curved along the curve indicated by an alternate long and two short dashed line in FIG. 13.

In this case, the sheet guide member 52 may be a flexible resin film. However, since the sheet guide member 52 has a characteristic shape, the sheet guide member 52 need not be flexible.

According to this structure, when a trailing end portion M2 of a document M moves to a merging section P2 from the reverse transport path 44, the entire trailing end portion M2 of the document M is not separated from the sheet guide member 52 at the same time, that is, the trailing end portion M2 of the document M can be gradually separated from the sheet guide member 52 at different timings.

Although not described in detail here, even the sheet guide member 52 shown in FIG. 13 provides the operational effects that are the same as the above-described operational effects provided by the sheet guide member 50 shown in FIG. 7.

In the sixth embodiment, as in the second embodiment, the case in which the sheet guide member 52 is not flexible is described. However, the sheet guide member 52 may be flexible. This makes it possible to expect a combination of the effects according to the sixth embodiment and the effect of reducing the jumping-up force of the trailing end portion M2 of the document M by the flexing of the sheet guide member 52.

Seventh Embodiment

A seventh embodiment is a modification of the third embodiment.

Figure 14:
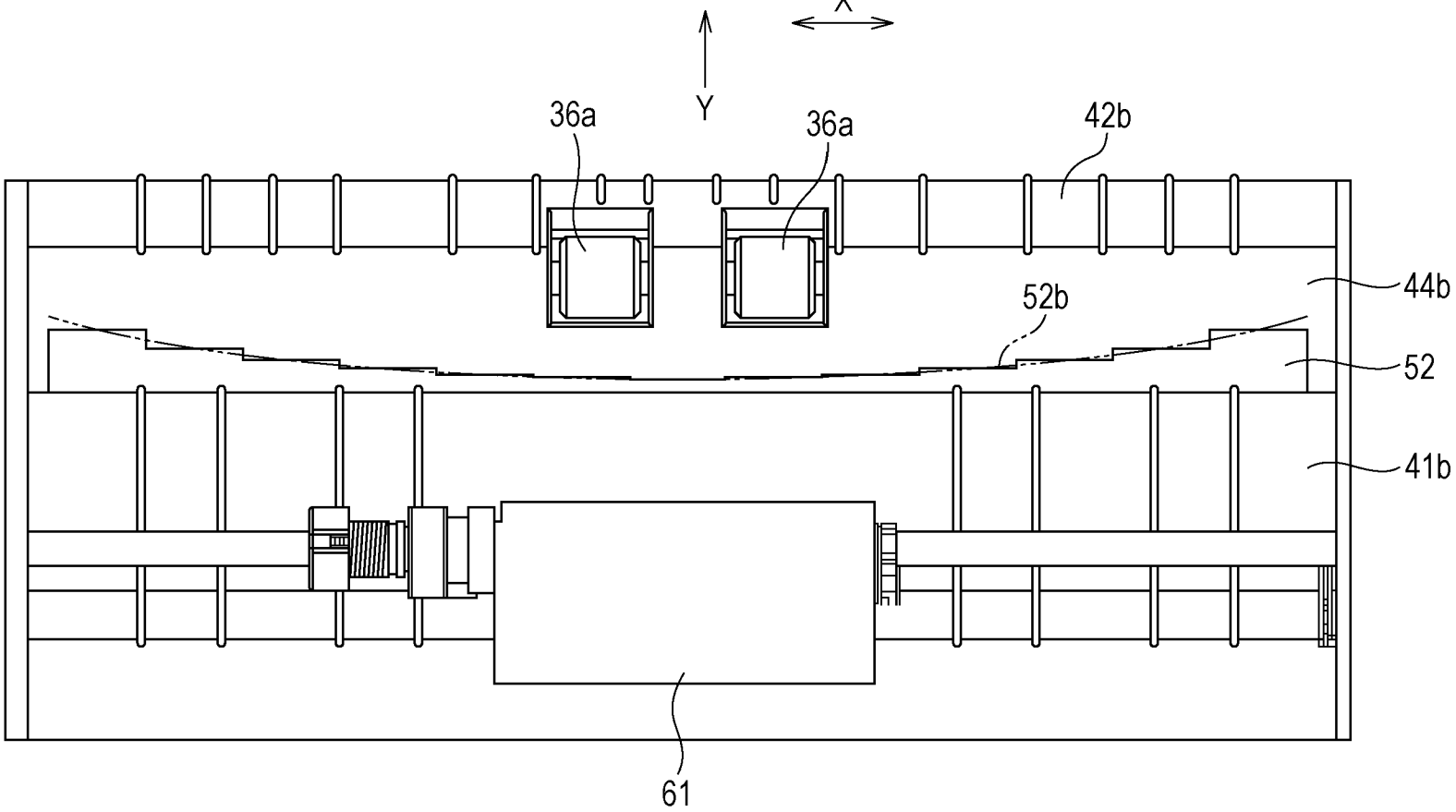
FIG. 14 shows a sheet guide member according to a seventh embodiment, and is an enlarged schematic plan view of a principal transport path and a reverse transport path.
Figure 15:
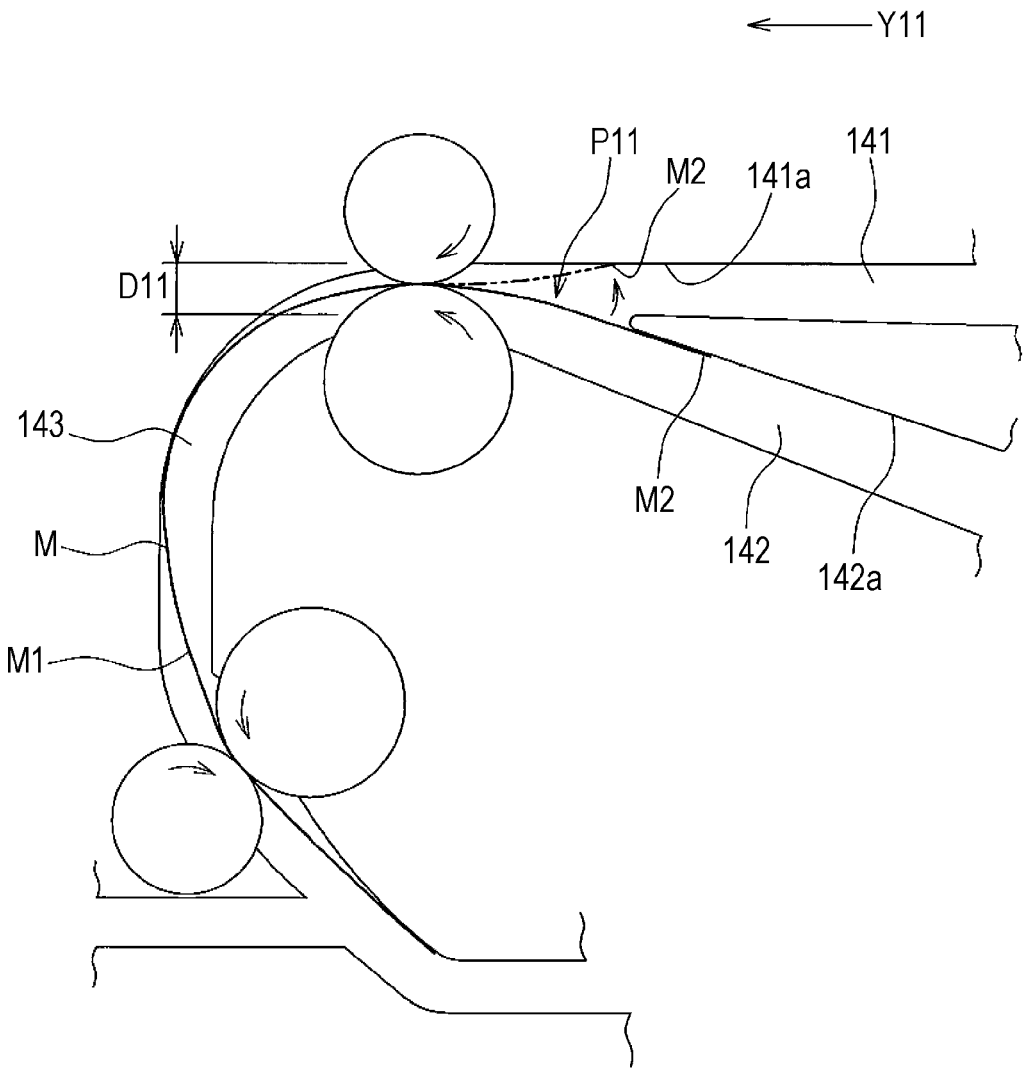
FIG. 15 is a schematic sectional view of an existing transport path structure in which a curved transport path is provided downstream in a transport direction from a merging section where a plurality of transport paths merge with each other.

FIG. 14 shows a sheet guide member 52 according to the seventh embodiment, and is an enlarged schematic plan view of a principal transport path and a reverse transport path.

In the sheet guide member 52 shown in FIG. 14, an end portion 52*b* is nonlinear along a sheet width direction X. More specifically, the sheet guide member 52 is formed so as to have a stepped form from a central portion to two outer sides thereof along the sheet width direction X. Here, in the seventh embodiment, the two outer sides are formed so as to protrude in a sheet transport direction Y with respect to the central portion of the sheet guide member 52. Although, in FIG. 14, a side of each stepped portion along the sheet width direction X is linear, it may be curved along the curve indicated by an alternate long and two short dashed line in FIG. 14.

In this case, the sheet guide member 52 may be a flexible resin film. However, since the sheet guide member 52 has a characteristic shape, the sheet guide member 52 need not be flexible.

According to this structure, when a trailing end portion M2 of a document M moves to a merging section P2 from the reverse transport path 44, the entire trailing end portion M2 of the document M is not separated from the sheet guide member 50 at the same time, that is, the trailing end portion M2 of the document M can be gradually separated from the sheet guide member 50 at different timings.

Although not described in detail here, even the sheet guide member 52 shown in FIG. 14 provides the operational effects that are the same as the above-described operational effects provided by the sheet guide member 50 shown in FIG. 9.

In the seventh embodiment, as in the third embodiment, the case in which the sheet guide member 52 is not flexible is described. However, the sheet guide member 52 may be flexible. This makes it possible to expect a combination of the effects according to the seventh embodiment and the effect of reducing the jumping-up force of the trailing end portion M2 of the document M by the flexing of the sheet guide member 52.

Although, in each of the embodiments, the case in which the sheet transporting device according to the disclosure is applied to a document feeder is exemplified, the sheet transporting device according to the disclosure may be applied to a similar structure of sheet transport paths in an image forming unit.

The sheet transporting device according to the disclosure may be applied to a similar transport path structure for a post-processing device that, for example, punches or sorts discharged sheets after image formation.

The embodiments that have been disclosed this time are exemplifications on all points, and are not be construed as being restrictive. Therefore, the technical scope of the present disclosure is not to be construed as being limited to only the scope of the above-described embodiments, and is to be defined on the basis of the claims. All changes within the scope of the claims, and equivalent meanings and scope are included.

The present disclosure provides a sheet transporting device, a document feeder, and an image forming apparatus, which excel in reducing or eliminating an unpleasant sound, such as a striking sound, during transport of a sheet; and its contribution in general to sheet transport path structures including a curved transport path disposed downstream in a sheet transport direction from a location situated closest to a merging section where a plurality of transport paths merge is huge.

The present disclosure contains subject matter related to that disclosed in Japanese Priority Patent Application JP 2014-177425 filed in the Japan Patent Office on Sep. 1, 2014, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A sheet transporting device in which a curved transport path is provided downstream in a sheet transport direction from a merging section where a plurality of transport paths, which are formed by a plurality of transport guides that transport sheets, merge, the sheet transporting device comprising:

a sheet guide member that extends into the merging section towards the curved transport path from one of the plurality of transport guides that is positioned at the merging section; wherein the sheet guide member is disposed such that an extending end portion at a downstream side of the sheet guide member in the sheet transport direction does not contact an upper transport guide of the plurality of transport guides in the merging section;

the sheet guide member is a flexible member;

the sheet guide member includes a plurality of sheet members disposed in a sheet width direction that is orthogonal to the sheet transport direction;

end portions of the plurality of sheet members at downstream sides of the plurality of sheet members in the sheet transport direction are located at different positions in the sheet transport direction; and the plurality of sheet members are positioned to directly contact a sheet that is being transported.

2. The sheet transporting device according to claim 1, wherein the flexible member is a resin film.

3. The sheet transporting device according to claim 1, wherein the extending end portion of the sheet guide member is nonlinear along the sheet width direction.

4. The sheet transporting device according to claim 3, wherein the extending end portion of the sheet guide member is curved along the sheet width direction.

5. The sheet transporting device according to claim 3, wherein the extending end portion of the sheet guide member has a stepped form from a central portion to two outer sides of the extending end portion along the sheet width direction.

6. The sheet transporting device according to claim 1, wherein the plurality of transport paths include a first transport path and a second transport path that are disposed upstream from the merging section;

the first transport path is defined by the upper transport guide and an upper intermediate transport guide of the plurality of transport guides, and the second transport path is defined by a lower intermediate transport guide and a lower transport guide of the plurality of transport guides; and a base end portion of the sheet guide member is secured to either one of the upper intermediate transport guide or the lower intermediate transport guide.

7. The sheet transporting device according to claim 6, wherein the base end portion of the sheet guide member is secured to, of the intermediate transport guides, the intermediate transport guide against which is pushed a trailing end portion of a sheet by jumping up of the sheet caused by flexing of the sheet that is being transported in the transport path.

8. A document feeder comprising:

the sheet transporting device according to claim 1.

9. An image forming apparatus comprising:

the document feeder according to claim 8.

10. A sheet transporting device in which a curved transport path is provided downstream in a sheet transport direction from a merging section where a plurality of transport paths, which are formed by a plurality of transport guides that transport sheets, merge, the sheet transporting device comprising:

a sheet guide member that extends into the merging section towards the curved transport path from one of the plurality of transport guides that is positioned at the merging section; wherein the plurality of transport paths include a first transport path and a second transport path that are disposed upstream from the merging section;

the first transport path is defined by an upper transport guide and an upper intermediate transport guide of the plurality of transport guides, and the second transport path is defined by a lower intermediate transport guide and a lower transport guide of the plurality of transport guides;

a step portion is provided on the lower intermediate transport guide;

a base end portion of the sheet guide member at an upstream side of the sheet guide member in the sheet transport direction is attached to the step portion;

a surface of the base end portion of the sheet guide member at the upstream side of the sheet guide member opposes the lower transport guide, and the surface of the base end portion is not covered by the lower intermediate transport guide;

the sheet guide member is disposed such that an extending end portion of the sheet guide member at a downstream side of the sheet guide member in the sheet transport direction does not contact the upper transport guide in the merging section; and the extending end portion of the sheet guide member is nonlinear along a sheet width direction that is orthogonal to the sheet transport direction.

11. The sheet transporting device according to claim 10, wherein the sheet guide member is a flexible member.

12. The sheet transporting device according to claim 11, wherein the flexible member is a resin film.

13. The sheet transporting device according to claim 10, wherein the extending end portion of the sheet guide member is curved along the sheet width direction.

14. The sheet transporting device according to claim 10, wherein the extending end portion of the sheet guide member has a stepped form from a central portion to two outer sides of the extending end portion along the sheet width direction.

15. The sheet transporting device according to claim 10, wherein the lower intermediate transport guide is pushed by a trailing end portion of a sheet by jumping up of the sheet caused by flexing of the sheet that is being transported in the transport path.

16. A document feeder comprising:

the sheet transporting device according to claim 10.

17. An image forming apparatus comprising:

the document feeder according to claim 16.

18. A sheet transporting device in which a curved transport path is provided downstream in a sheet transport direction from a merging section where a plurality of transport paths, which are formed by a plurality of transport guides that transport sheets, merge, the sheet transporting device comprising:

a sheet guide member that extends into the merging section towards the curved transport path from one of the plurality of transport guides that is positioned at the merging section; wherein the plurality of transport paths include a first transport path and a second transport path that are disposed upstream from the merging section;

the first transport path is defined by an upper transport guide and an upper intermediate transport guide of the plurality of transport guides, and the second transport path is defined by a lower intermediate transport guide and a lower transport guide of the plurality of transport guides;

a step portion is provided on the lower intermediate transport guide;

a base end portion of the sheet guide member at an upstream side of the sheet guide member in the sheet transport direction is attached to the step portion;

a surface of the base end portion of the sheet guide member at the upstream side of the sheet guide member opposes the lower transport guide, and the surface of the base end portion is not covered by the lower intermediate transport guide;

the sheet guide member is disposed such that an extending end portion of the sheet guide member at a downstream side of the sheet guide member in the sheet transport direction does not contact the upper transport guide in the merging section;

the sheet guide member includes a plurality of sheet members disposed in a sheet width direction that is orthogonal to the sheet transport direction; and end portions of the plurality of sheet members at downstream sides of the plurality of sheet members in the sheet transport direction are located at different positions in the sheet transport direction.

19. A document feeder comprising:

the sheet transporting device according to claim 18.

20. An image forming apparatus comprising:

the document feeder according to claim 19.

* * * * *